US008375612B2

(12) United States Patent
Talip

(10) Patent No.: US 8,375,612 B2
(45) Date of Patent: Feb. 19, 2013

(54) IRON SOLEPLATE COVER AND STORAGE UNIT

(75) Inventor: Murat Kolbasi Talip, Eyup-Istanbul (TR)

(73) Assignee: Arzum Elektrikli ev Aletleri Sanayi Ticaret Aninim Sirketi, Eyup-Istanbul (TR)

( * ) Notice: Subject to any disclaimer, the term of this patent is extended or adjusted under 35 U.S.C. 154(b) by 150 days.

(21) Appl. No.: 13/029,446

(22) Filed: Feb. 17, 2011

(65) Prior Publication Data

US 2011/0289804 A1 Dec. 1, 2011

(30) Foreign Application Priority Data

Jun. 1, 2010 (TR) ..... u 2010 04366

(51) Int. Cl.
*D06F 79/02* (2006.01)
*D06F 75/08* (2006.01)

(52) U.S. Cl. ..... 38/96; 219/259; 248/117.6

(58) Field of Classification Search ..... 38/79, 93–98; 248/117.1–117.4; 219/245, 259
See application file for complete search history.

(56) References Cited

U.S. PATENT DOCUMENTS

| | | | | | |
|---|---|---|---|---|---|
| 1,759,214 | A | * | 5/1930 | Winters | 248/117.1 |
| 2,486,448 | A | | 11/1949 | Trazler | |
| 2,529,132 | A | | 11/1950 | Burnish, III et al. | |
| 2,657,000 | A | * | 10/1953 | Tonks | 248/117.6 |
| 2,902,576 | A | * | 9/1959 | Miller | 219/245 |
| 3,062,492 | A | * | 11/1962 | Hedger | 248/117.1 |
| 3,162,415 | A | * | 12/1964 | St Pierre | 248/117.6 |
| 3,176,947 | A | * | 4/1965 | Inverso | 248/117.6 |
| 3,305,200 | A | * | 2/1967 | Avery | 248/117.6 |
| 5,108,056 | A | * | 4/1992 | McBounds | 248/117.4 |
| 5,909,862 | A | | 6/1999 | Ratliff et al. | |
| 6,116,550 | A | | 9/2000 | Forbes | |
| 2010/0199529 | A1 | * | 8/2010 | Ma et al. | 38/77.1 |

FOREIGN PATENT DOCUMENTS

| | | | |
|---|---|---|---|
| CN | 1938473 | A | 3/2007 |
| GB | 721282 | A | 1/1955 |
| GB | 2456412 | A | 7/2009 |

* cited by examiner

*Primary Examiner* — Ismael Izaguirre
(74) *Attorney, Agent, or Firm* — Gardner Groff Greenwald & Villanueva, PC

(57) ABSTRACT

An iron soleplate cover and storage unit is characterized in that it has a nose grip mounted on the soleplate, a nose part which has two folding details in its front part, a tail part which has two rail rods in its back part and one folding detail, nose clips, a left rail cover to cover a left rail recess on the nose part, left rail cover to cover the right rail recess on the nose part, and hanger unit, and it enables safe and compact storage after use and is suitable for irons.

13 Claims, 5 Drawing Sheets

IRON SOLEPLATE COVER AND STORAGE UNIT

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

This invention is related to an iron soleplate cover and storage unit.

2. Description of Related Art Including Information Disclosed Under 37 CFR 1.97 and 37 CFR 1.98

Conventional Products

Some existing conventional soleplate covers offer protection for the iron soleplates. But their designs do not offer a practical mounting onto the soleplate. Besides, for safety issues the user has to wait for the soleplate to cool down. These designs are also not compatible with irons of different designs.

There are some designs in the market that enable the iron to be stored after usage. But these designs do not offer a solution for cable management. In addition to that, the user has to store the iron in a specific way.

The iron soleplate cover and storage unit of the present invention solves all the safety and storage issues in one compact product. The solution is compatible with a wide range of iron designs of different brands in the market.

The Purpose

The purpose of this product is to develop a completely new soleplate cover, which offers safe and compact storage options before and after usage. This soleplate cover has a 2-part body with a flexible mechanism that enables it to be used with different irons.

There are some conventional products at the market, which offer solutions to the storage and safety problems. But these designs are inadequate in compatibility, safety, practicality and cable management.

The main objective of this product is to offer adequate solutions to all these problems through one compact, adaptable soleplate cover and storage unit.

BRIEF SUMMARY OF THE INVENTION

The present invention is an iron soleplate cover and storage unit and it is characterized in that it has a nose grip mounted on the soleplate (1*a*), a nose part (1) which has two folding details (1*e*, 1*f*) in its front part, a tail part (2) which has two rail rods (2*c*, 2*d*) in its back part and one folding detail (2*e*), nose clips (3), left rail cover (4) to cover left rail recess on the nose part, left rail cover (5) to cover the right rail recess (1*b*, 1*c*) on the nose part, and a hanger unit (6), and it enables safe and compact storage after use and is suitable for irons.

Figure 1:
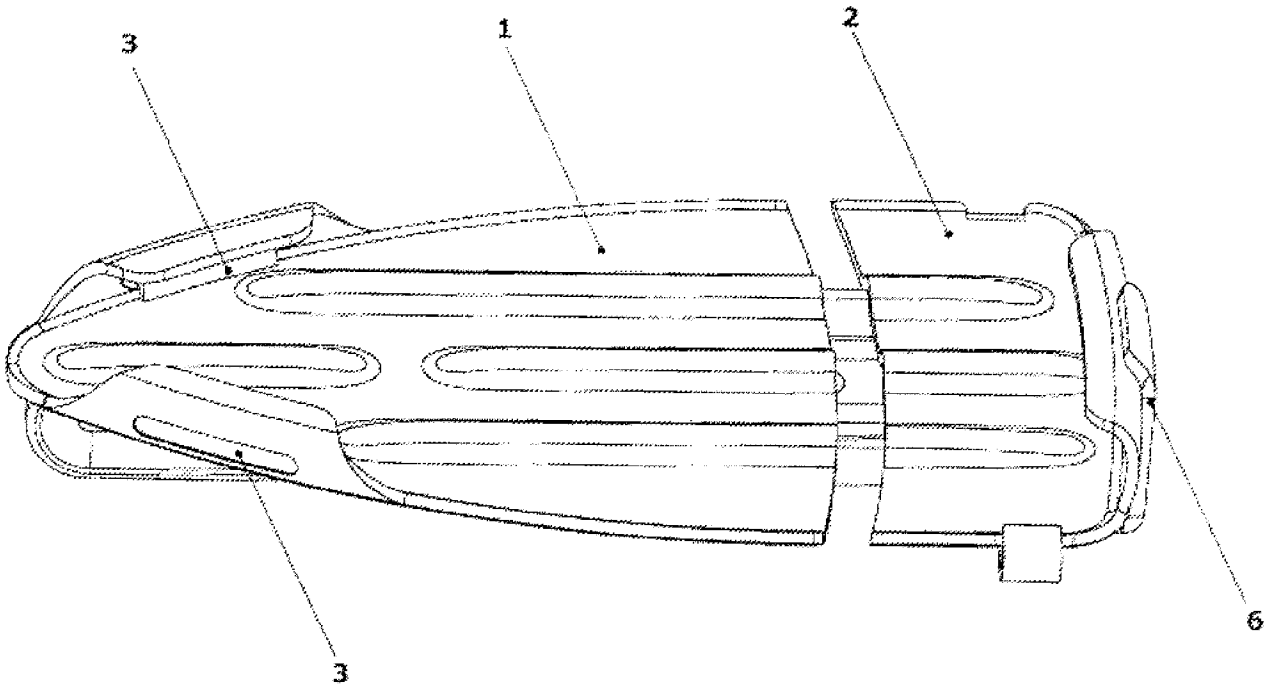
FIG. 1 is an upper perspective view of the iron soleplate cover and storage unit of the present invention.

THE DESCRIPTION OF THE NUMERALS ON THE FIGURES (1) Nose part
(1*a*) Nose grip
(1*b*) Left rail recess
(1*b*-1) Left rail anchor
(1*c*) Right rail recess
(1*c*-1) Right rail anchor
(1*d*) Hanger recess
(1*e*) Nose left fold
(1*f*) Nose right fold
(1*g*) Nose part cambers
(2) Tail part
(2*a*) Left cable clip
(2*b*) Right cable clip
(2*c*) Left rail rod
(2*c*-1) Left rail rod slot
(2*d*) Right rail rod
(2*d*-1) Right rail rod slot
(2*e*) Tail fold
(20 Tail part cambers
(3) Nose clip
(4) Left rail cap
(5) Right rail cap
(6) Hanger

DETAILED DESCRIPTION OF THE INVENTION

The iron soleplate cover and storage unit has five parts: the nose part (1) with two fold details (1*e*, 1*f*) at the front; the tail part (2) with two rail rods (2*c*, 2*d*) and a fold detail (2*e*) at the back; the left rail cap (4) to cover the left rail recess on the nose part; the right rail cap (5) to cover the right rail recess (1*b*, 1*c*) on the nose part; and the hanger unit (6).

The main feature of the iron soleplate cover and storage unit is its compatibility. The nose part (1) and the tail part (2) are attached through a flexible rail rod system so that the length of the unit can vary to fit on different irons with different sizes of soleplates.

The nose part (1) catches the iron's soleplate on the nose with two nose clips (3) that are mounted on the nose folds (1*e*, 1*f*). The tail part (2) catches the soleplate on the back with the tail fold (2*e*). The rail rods (2*c*, 2*d*) on the tail part (2) can slide in the rail recesses (1*b*, 1*c*). Two flexible bands are attached between rail rod slots (2*c*-1, 2*d*-1) and rail anchors (1*b*-1, 1*c*-1) to connect the tail part (2) and on the nose part (1)

together. The left and right rail caps (4, 5) are mounted on the rail recesses (1*b*, 1*c*) to cover up the details.

The nose grip (1*a*) offers an ergonomic and safe grip while mounting it onto the soleplate.

The nose clips (3) are equipped with temperature sensitive color changing polymer bands to warn the user for a hot soleplate.

The cable clips (2*a*, 2*b*) are on the tail part (2) for a compact storage. The iron soleplate cover and storage unit can be stored on any horizontal surface or can be hanged on any vertical surface by using the hanger (6). The hanger (6) carries the weight of the iron on the tail part and passes through the hanger recess (1*d*) on the tail part (1) to ensure the stability on vertical storage.

The nose part (1) and tail part (2) both have camber details (1*g*, 2*f*) on their surface to minimize the heat transfer between the unit and the soleplate.

Figure 5:
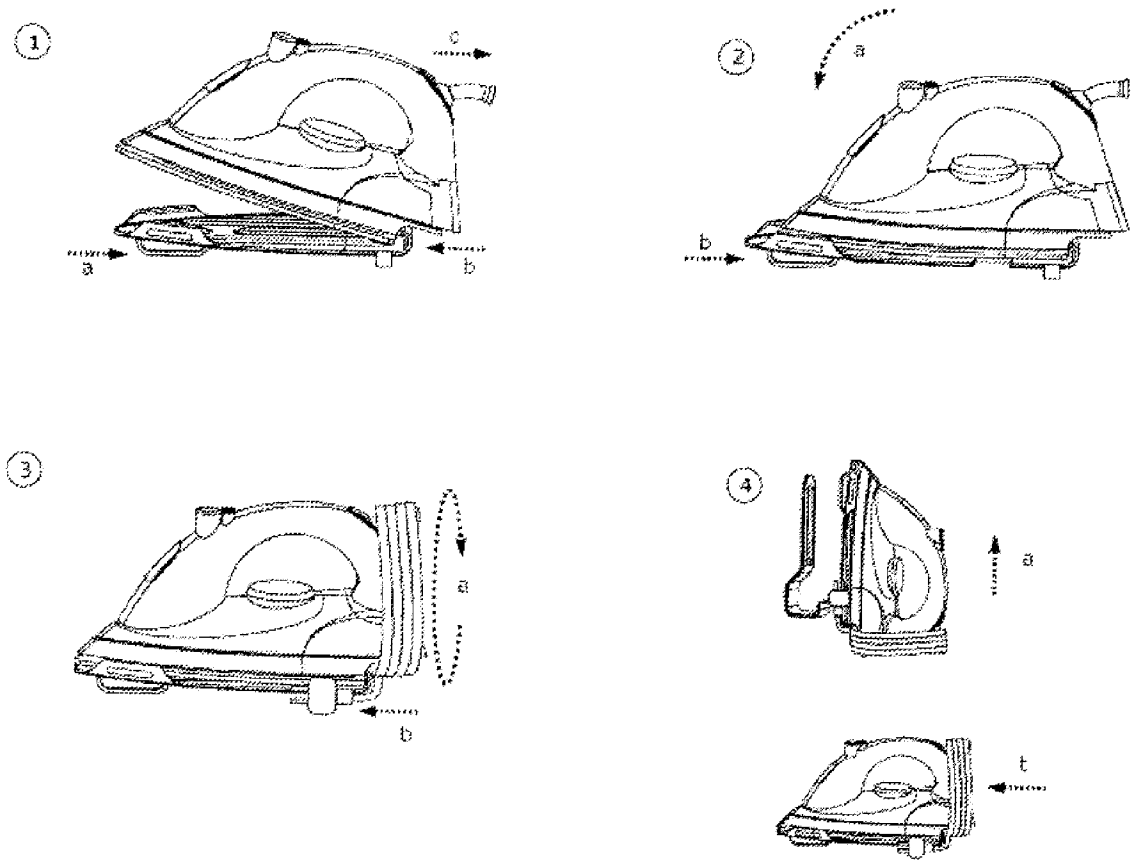
FIG. 5 is a schematic view showing usage of the iron soleplate cover and storage unit of the present invention.

Operation of the iron soleplate and storage unit is shown in FIG. 5.

In FIG. 5-1: the unit is held by the nose grip (1*a*); the soleplate of the iron is snagged under the tail fold (2*e*); and the iron is held on its handle and pulled to elongate the unit.

Figure 2:
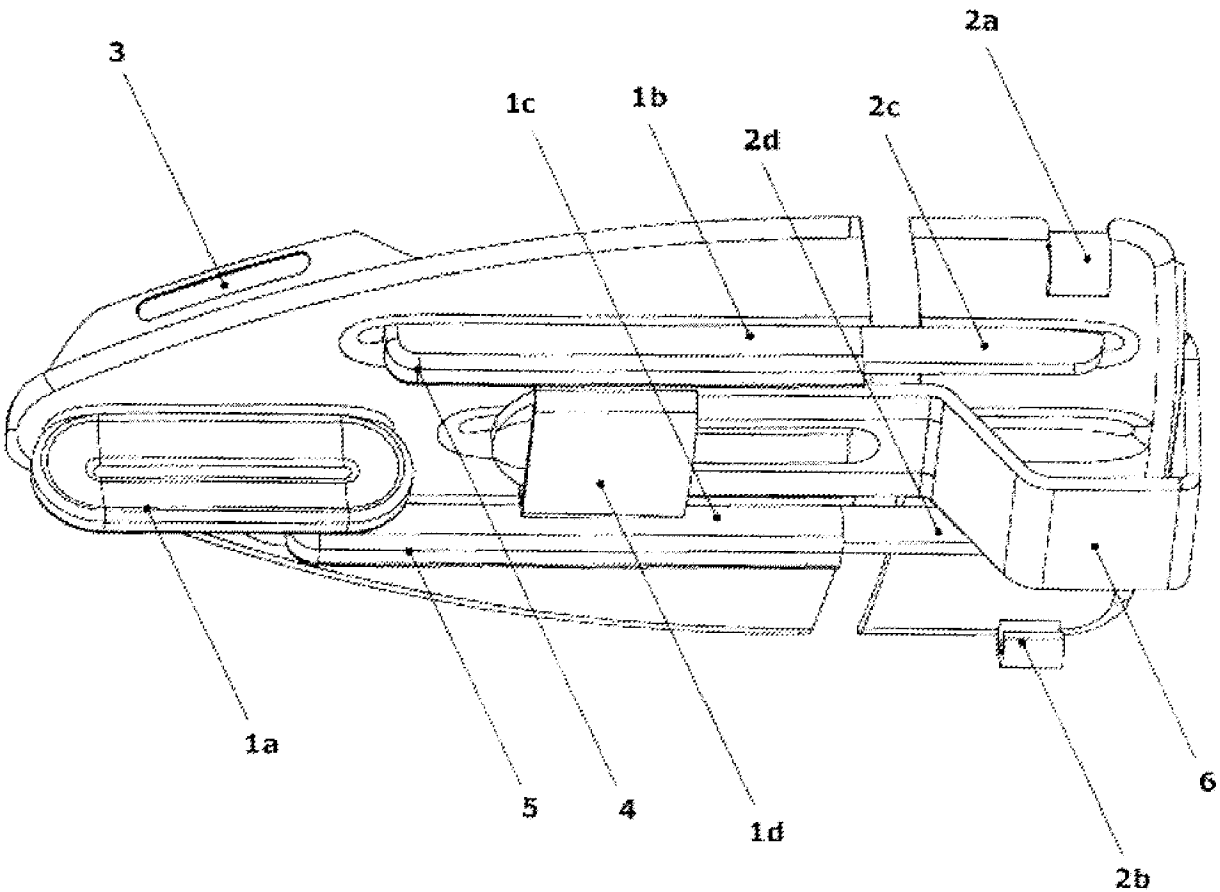
FIG. 2 is a lower perspective view of the iron soleplate cover and storage unit of the present invention.

In FIG. 5-2: the iron is set down onto the unit; and the nose part (1) is left to slide until it grips the soleplate by the nose with the nose clips (3) in the nose folds (1*e*, 1*f*).

Figure 3:
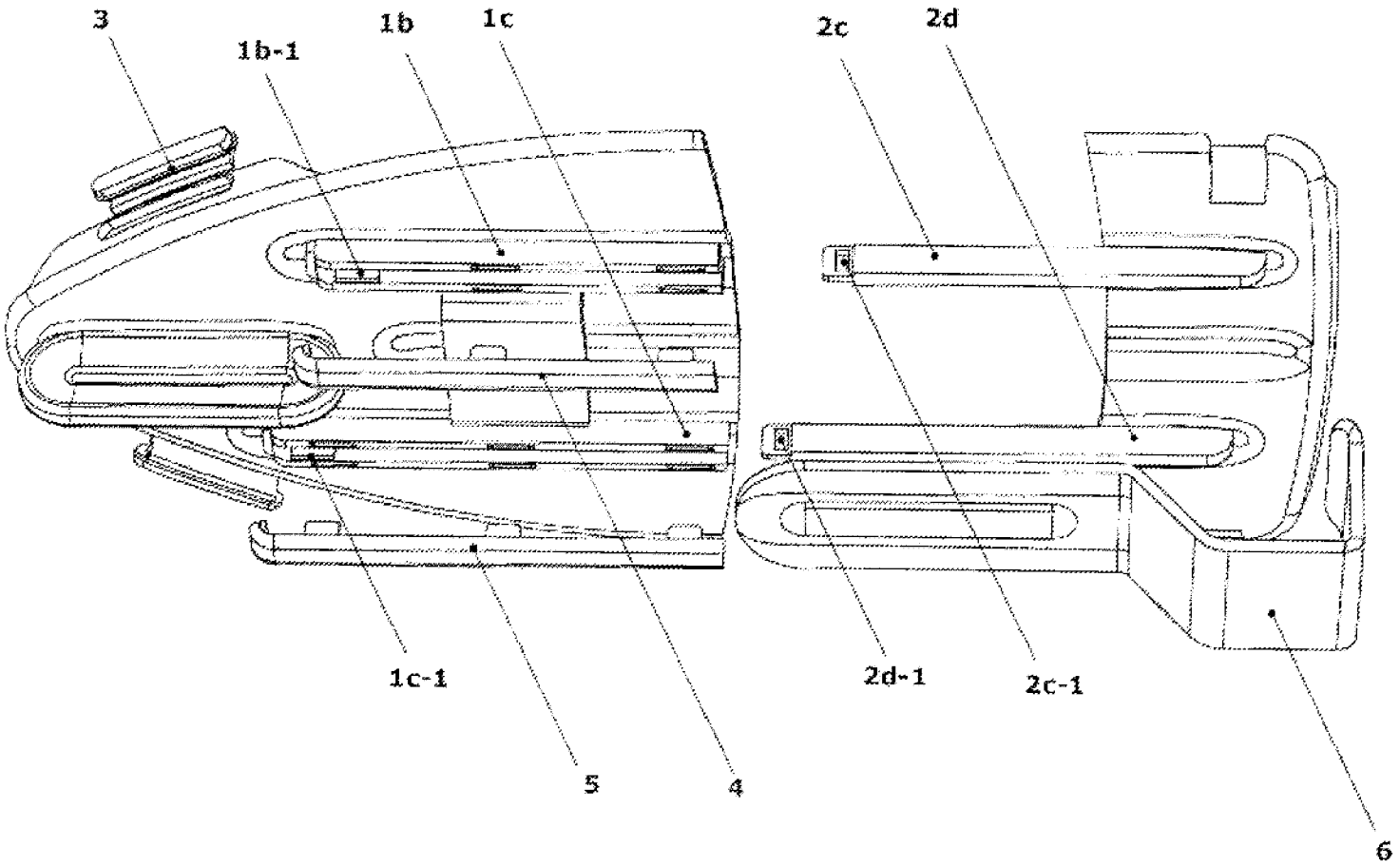
FIG. 3 is an exploded lower perspective view of the iron soleplate cover and storage unit of the present invention.

In FIG. 5-3: the cable is winded on the iron; and the plug is attached into one of the cable clips (2*a*, 2*b*).

Figure 4:
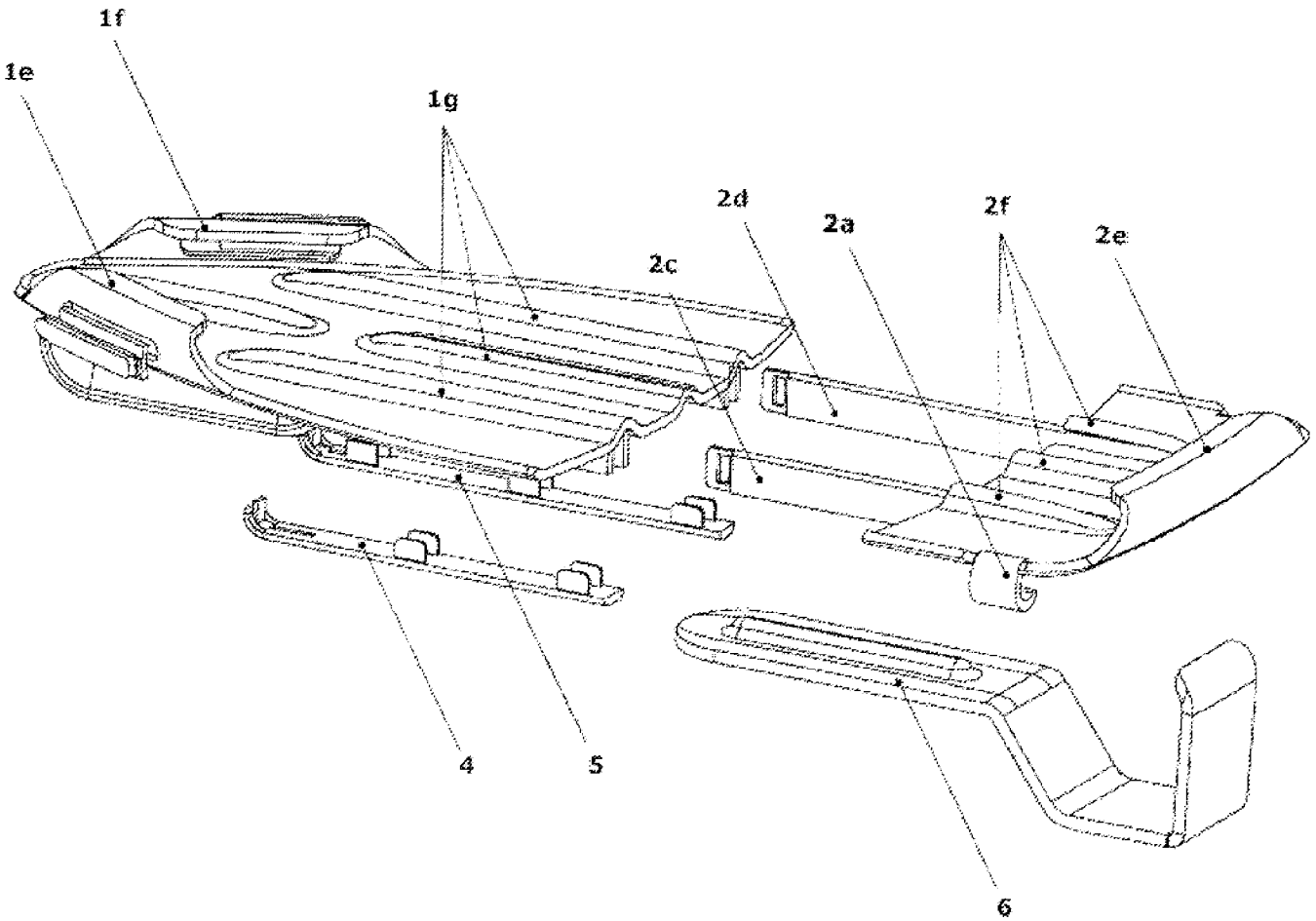
FIG. 4 is an exploded perspective view of the iron soleplate cover and storage unit of the present invention.

In FIG. 5-4: the iron can be carried by gripping it on its handle; and it can be stored horizontally or vertically on the hanger (6).

The advantages of iron soleplate cover and storage (ISCSU) unit are numerous and include the following. The ISCSU is compatible with different iron designs. It can be mounted easily and safely onto the iron while it is hot. The user does not have to wait the soleplate to cool down. The nose is equipped with temperature sensitive color changing polymer bands on both sides to warn the user for a hot soleplate. The ISCSU is equipped with cable clips on both sides to enable compact storage. It offers horizontal and vertical storage options.

I claim:

1. An iron soleplate cover and storage unit comprising: a nose grip mounted on the soleplate, a nose part which has two folding details in its front part, a tail part which has two rail rods in its back part and one folding detail, nose clips, left rail cover to cover left rail recess on the nose part, right rail cover to cover the right rail recess on the nose part, and hanger unit.

2. The iron soleplate cover and storage unit of claim 1, wherein the nose part and the tail part are set in by means of a rail-rod system for changing it to fit it to the different irons comprising soleplates with different sizes, wherein the rail-rod system comprises cables that are configured to wind about the irons, at least two cable clips secured to the tail part, and plugs at the end points of the cables.

3. The iron soleplate cover and storage unit of claim 1, wherein the nose part catches the soleplate of the iron on the nose, which is mounted on the nose folds and has two nose clips.

4. The iron soleplate cover and storage unit of claim 1, wherein the tail part has a tail fold that catches the soleplate on the back part, on which the rail rods can slide inside the rail recesses.

5. The iron soleplate cover and storage unit of claim 1, wherein the left and right rail covers are mounted on the rail recesses to cover left and right anchors secured in the rail recesses.

6. The iron soleplate cover and storage unit of claim 1, wherein the nose clips are furnished with polymer bands, which are sensitive to temperature and change color to warn the user that the soleplate is hot.

7. The iron soleplate cover and storage unit of claim 1, further comprising cable clips, which are placed on the tail part for more compact storage.

8. The iron soleplate cover and storage unit of claim 1, wherein the unit is configured to be stored in any horizontal surface or can be hanged by means of a hanger, which carries the weight of the iron and mounted on the nose part to be sure that vertical storage is stable and transfers the weight through hanger recess.

9. The iron soleplate cover and storage unit of claim 1, wherein the unit comprises camber details on its surfaces to minimize the heat transfer of both nose part and the tail part between unit and the plate.

10. The iron soleplate cover and storage unit of claim 1, wherein the unit is held in the nose grip side, the soleplate of the iron is caught at the bottom of the tail fold of the soleplate of the iron and it is pulled to elongate the unit by holding the iron in place.

11. The iron soleplate cover and storage unit of claim 2, wherein to operate it, the iron is placed on the unit, the nose part is slid from the left until the soleplate of the iron is caught by the nose, which has nose clips in the nose folds.

12. The iron soleplate cover and storage unit of claim 11, wherein the cable is configured to be winded on the iron and the plug is configured to be fixed in one of the cable clips.

13. The iron soleplate cover and storage unit of claim 12, wherein it is configured to be carried by holding the iron and then it can be stored horizontally or vertically on the hanger.

* * * * *